US007922543B1

(12) United States Patent
Chen

(10) Patent No.: US 7,922,543 B1
(45) Date of Patent: Apr. 12, 2011

(54) AUDIO JACK CONNECTOR

(75) Inventor: Song-Ya Chen, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/890,690

(22) Filed: Sep. 26, 2010

(51) Int. Cl.
*H01R 24/04* (2006.01)

(52) U.S. Cl. ..... 439/668

(58) Field of Classification Search ..... 439/188, 439/668, 669
See application file for complete search history.

(56) References Cited

U.S. PATENT DOCUMENTS 7,794,285 B1 * 9/2010 Huang ..... 439/668

* cited by examiner

*Primary Examiner* — Tho D Ta
(74) *Attorney, Agent, or Firm* — Zhigang Ma

(57) ABSTRACT

An audio jack connector includes a dielectric housing defining an inserting hole, a movable member, a rotation member, two first switch terminals and two-second switch terminals. The movable member is movably received in the dielectric housing. The rotation member is rotatably received in the dielectric housing. Elastic protrusions protrude from one end of the rotation member. Recessed portions form between every two protrusions. Ends of two first and second switch terminals respectively include a prong, and opposite ends are received in the recessed portion. A plug connector is inserted into the inserting hole, and pushes the movable member to move. The rotation member is driven to rotate to drive the ends of the two first switch terminals and the two second switch terminals to move from the recessed portion to the protrusion, causing the prongs to stay contact with the plug connector.

16 Claims, 7 Drawing Sheets

AUDIO JACK CONNECTOR

BACKGROUND

1. Technical Field

The present disclosure relates to connectors and, particularly, to an audio jack connector.

2. Description of Related Art

A conventional audio jack connector includes a dielectric housing, and a set of elastic switch terminals received in the dielectric housing. The dielectric housing defines an inserting hole in a front end thereof and extending therethrough. When a conventional plug connector is inserted into the inserting hole, the elastic switch terminals contact the conventional plug connector to make an electrical connection with the conventional plug connector. After repeated plugging/unplugging of the conventional plug connector, the audio jack connector and/or the conventional plug connector may wear out. Thus, the conventional plug connector may tend to detach unintentionally from the audio jack connector.

Therefore, what is needed is an audio jack connector to overcome the described shortcoming.

DETAILED DESCRIPTION

Figure 1:
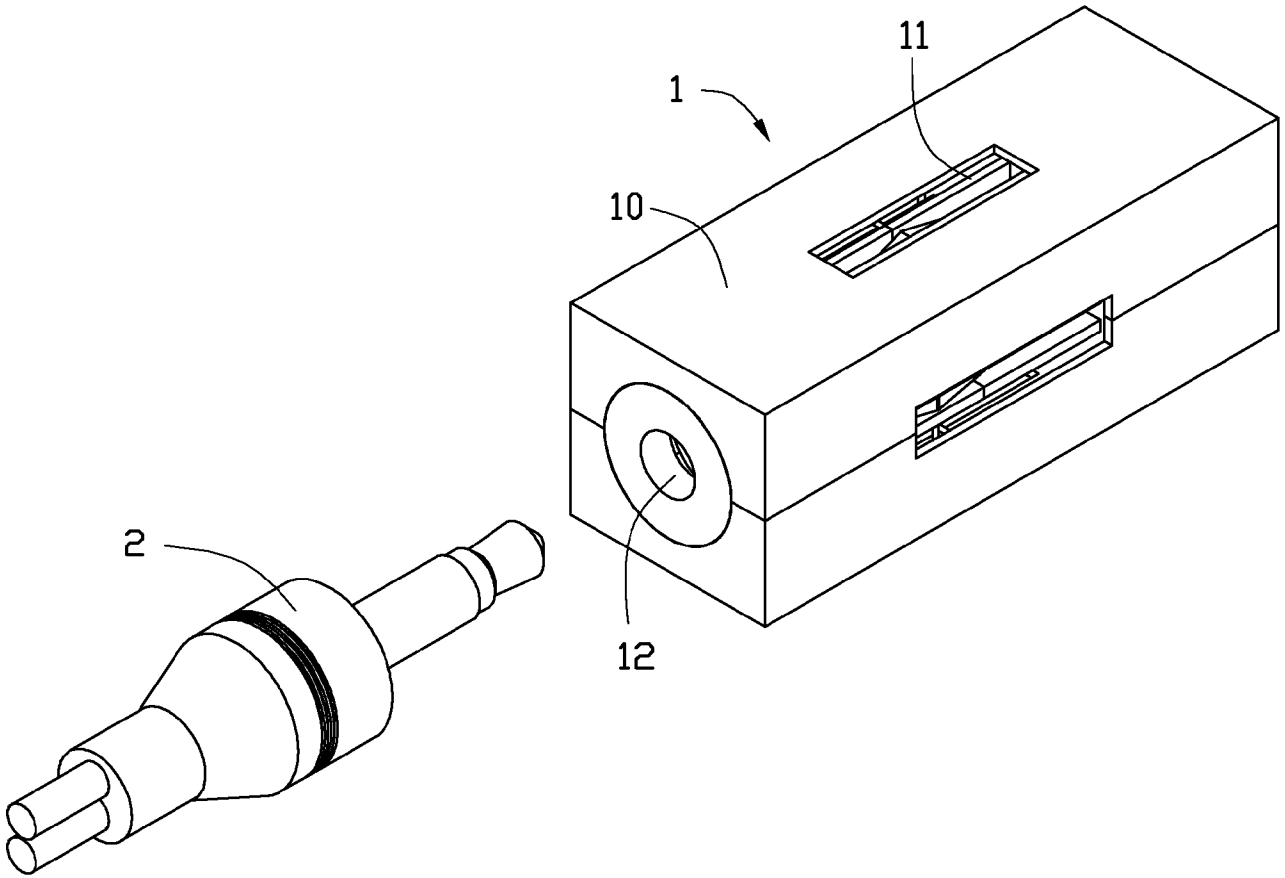
FIG. 1 is an isometric view of an audio jack connector in accordance with an exemplary embodiment, and a conventional plug connector.

Referring to FIG. 1, an audio jack connector 1 is illustrated, in accordance with an exemplary embodiment. The audio jack connector 1 includes a dielectric housing 10. The dielectric housing 10 defines an inserting hole 12 in a sidewall and a receiving space 11 communicating with the inserting hole 12. A conventional plug connector 2 can be inserted into the inserting hole 12 to establish an electrical connection with the audio jack connector 1.

Figure 2:
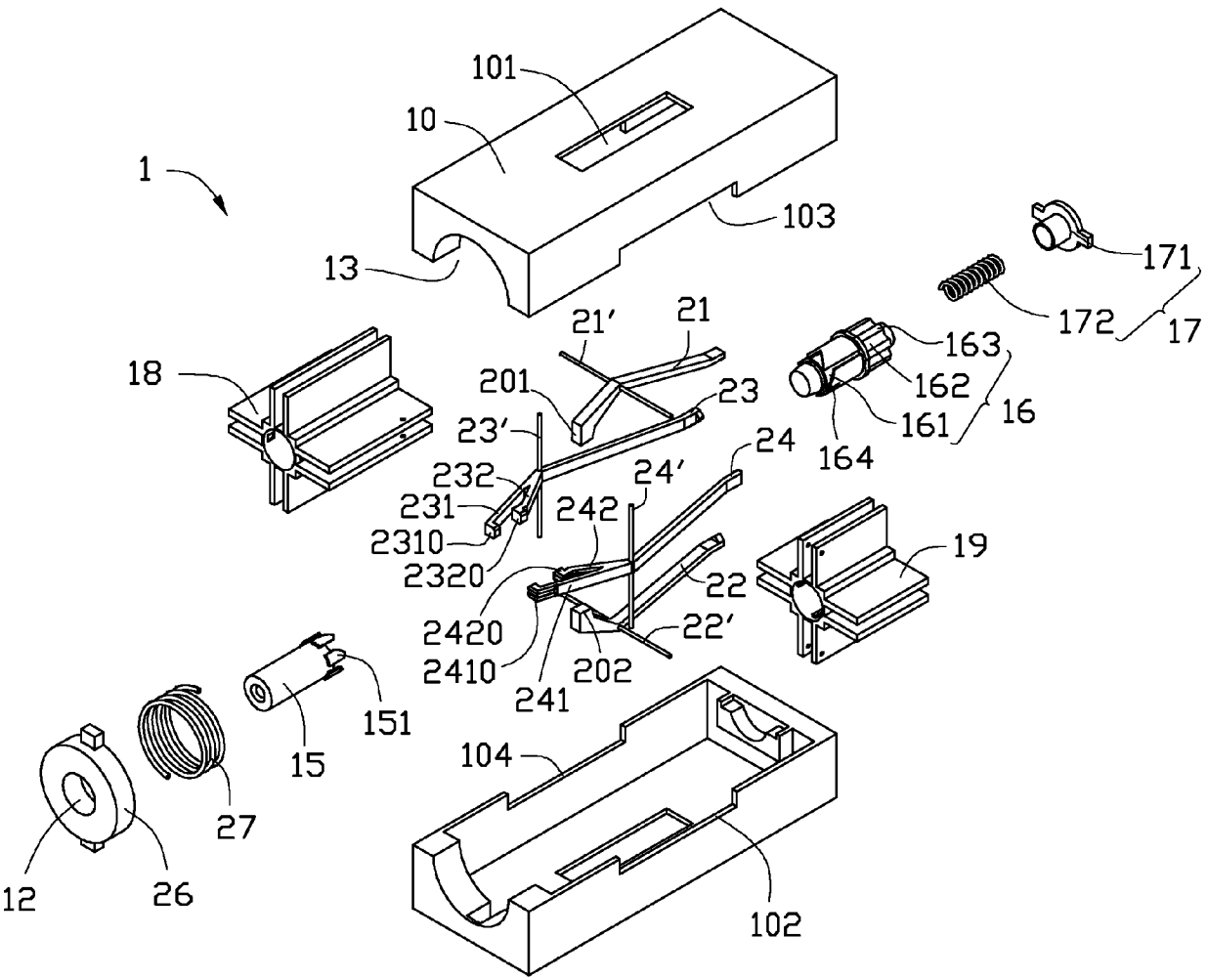
FIG. 2 is an exploded view of the audio jack connector of FIG. 1.

Referring to FIG. 2, the housing 10 accommodates a movable member 15, a rotation member 16, two first switch terminals 23, 24, and two second switch terminals 21, 22. The length of each first switch terminal exceeds that of each second switch terminal. Depending on different embodiments, the numbers of the first switch terminals and the second switch terminals could be one or more than two.

Figure 6:
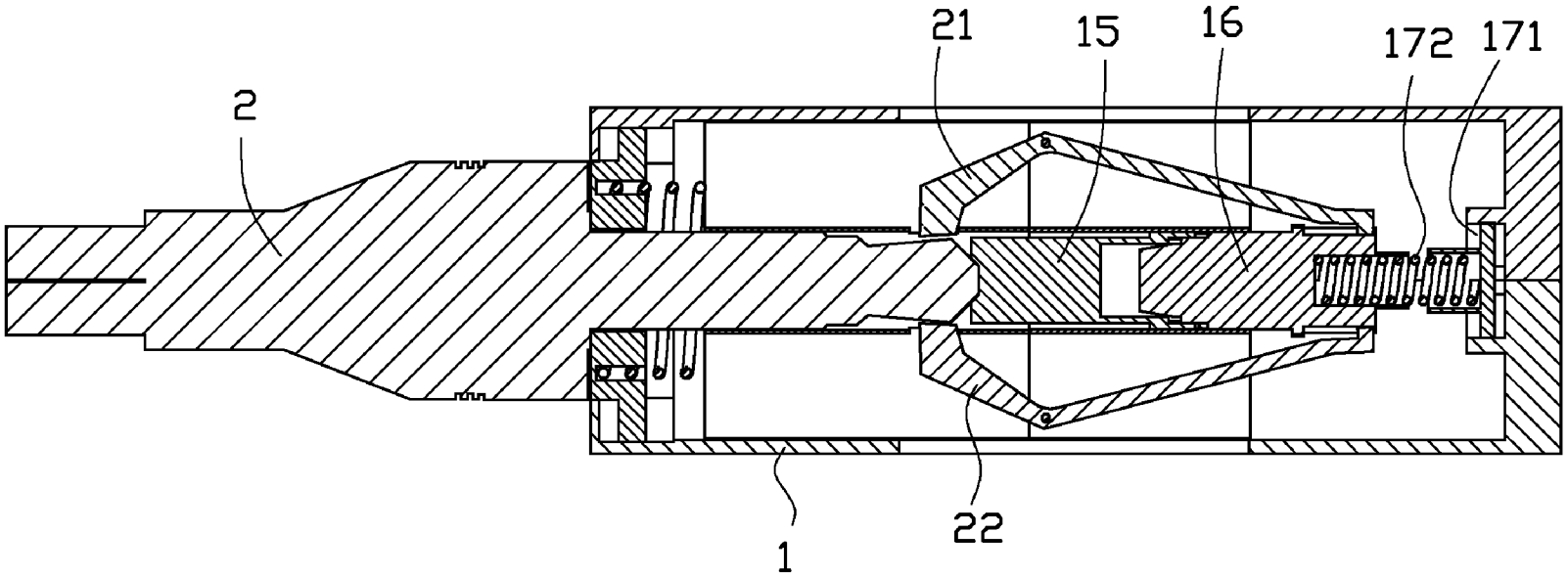
FIG. 6 is a cross-sectional view of the conventional plug connector and the audio jack connector of FIG. 5, taken along the line VI-VI.

The movable member 15 is aligned with the inserting hole 12 of the housing 10 (see FIG. 6). The movable member 15 can be pushed by the plug connector 2 to move inward.

The rotation member 16 can be pushed by the movable member 15 to rotate. A number of elastic protrusions 163 protrude from the lateral surface of one end of the rotation member 16. A number of recessed portions 162 form between every two protrusions 163.

Ends of the two first switch terminals 23, 24 and the two second switch terminals 21, 22 are respectively placed in the recessed portions 162, and opposite ends of the two first switch terminals 23, 24 and the two second switch terminals 21, 22 each include a prong for establishing an electrical connection with the conventional plug connector 2.

When the conventional plug connector 2 is inserted into the receiving space 11 and pushes the movable member 15 to move, the rotation member 16 is driven to rotate a predetermined angle, causing the ends of the two first switch terminals 23, 24 and the two second switch terminals 21, 22 to respectively stay in contact with the protrusions 163. Due to the application of a lever principle, the prongs of the two first switch terminals 23, 24 and the two second switch terminals 21, 22 move toward and stay in contact with the conventional plug connector 2. In order to better understand the disclosure, an exemplary embodiment will be described in detail.

The dielectric housing 10 is hollow, and defines an opening 13 in one end. The audio jack connector 1 further includes a cylindrical member 26 and a spring 27. The cylindrical member 26 is received in the opening 13. The inserting hole 12 is defined in the center of the cylindrical member 26. The housing 10 defines four slots 101, 102, 103, 104 in its four sidewalls along a lengthwise direction thereof, respectively. In one embodiment, a number of electrical contact terminals (not labeled) are set in a lateral surface of the dielectric housing 10, and are used for establishing an electrical connection with an external electronic device.

One end of the movable member 15 adjacent to the inserting hole 12 defines an opening (not labeled), and an opposite end defines a number of respective tongues 151.

One end of the rotation member 16 adjacent to the movable member 15 defines a number of sliding grooves 161 in its lateral surface. Each sliding groove 161 includes an inclined surface 164. During the movement of the movable member 15, the tongues 151 slide along the inclined surface 164 to drive the rotation member 16 to rotate.

One end of the first switch terminal 23 adjacent to the movable member 15 includes two sub-switch terminals 231, 232 which respectively include a prong 2310, 2320. An opposite end of the first switch terminal 23 is received in the recessed portion 162. Similarly, one end of the first switch terminal 24 adjacent to the movable member 15 includes two sub-switch terminals 241, 242 which respectively include a prong 2410, 2420. An opposite end of the first switch terminal 24 is received in the recessed portion 162. One end of each of the two second switch terminals 21, 22 adjacent to the movable member 15 respectively includes a prong 201, 202, and an opposite end is received in the recessed portion 162.

The first switch terminals 23, 24 each include a first fixing shaft 23', 24' and define a hole at a bent portion thereof. The second switch terminals 21, 22 each include a second fixing shaft 21', 22' and define a hole at a bent portion thereof.

The audio jack connector 1 further includes a base 17. The base 17 is connected to one end of the movable member 15, and includes a fixing portion 171 and an elastic element 172. One end of the elastic element 172 is connected to one end of the movable member 15 away from the inserting hole 12, and an opposite end is connected to the fixing portion 171. In one embodiment, the elastic element 172 is a spring.

Figure 3:
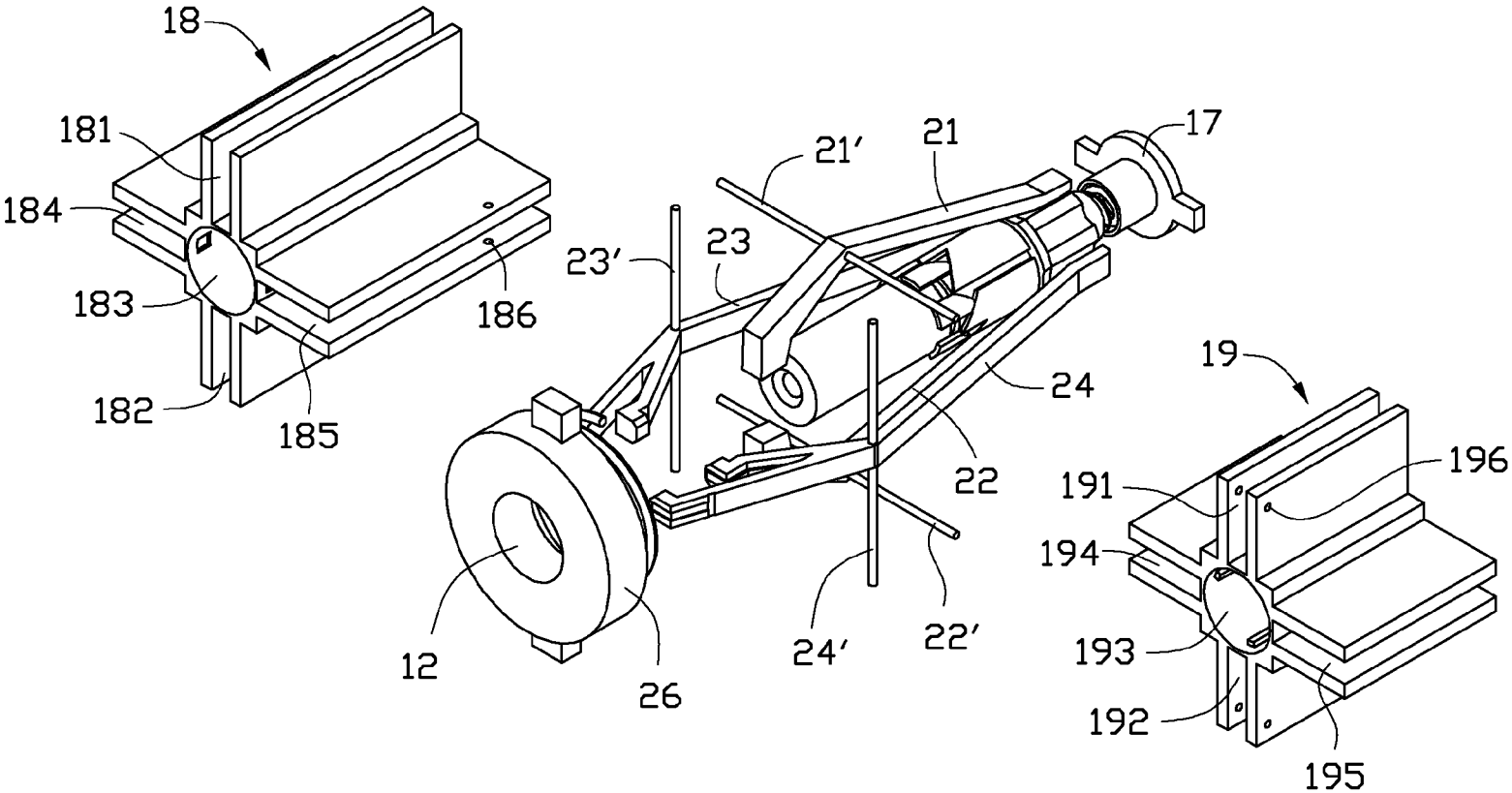
FIG. 3 is a partially assembled view of the audio jack connector of FIG. 2, with a housing omitted.
Figure 4:
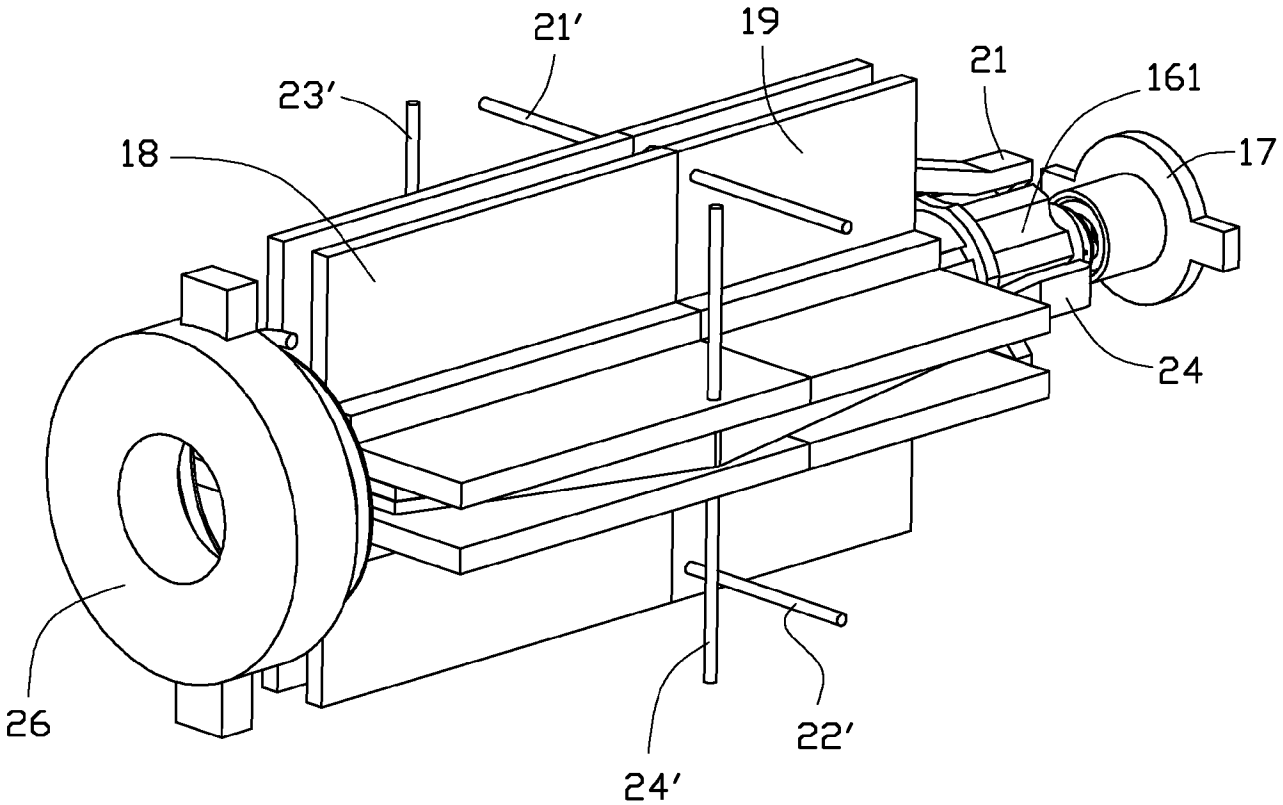
FIG. 4 is a further assembled view of the audio jack connector of FIG. 2.

Referring also to FIG. 3, the audio jack connector 1 further includes a first fixing member 18 and a second fixing member 19. The first fixing member 18 is substantially rectangular and defines a through hole 183 along its longitudinal direction.

The movable member 15 is movably received in the through hole 183. The first fixing member 18 further includes four pairs of first side plates 181, 182, 184, 185 protruding from its four sidewalls. The two first side plates 184, 185 each define a first axle hole 186. The two first switch terminals 23, 24 are respectively received in the space between the first side plates 184, 185. The two first fixing shafts 23', 24' respectively pass through the first axle holes 186 and the holes of the bent portion of the first switch terminals 23, 24 to rotatably connect the two first switch terminals 23, 24 to the first fixing member 18.

The second fixing member 19 defines a through hole 193 along its longitudinal direction, and communicating with the through hole 183. The rotation member 16 is rotatably received in the through hole 193. The second fixing member 19 further includes four pairs of second side plates 191, 192, 194, 195 protruding from its four sidewalls. The two second side plates 191, 192 each define a second axle hole 196. The two second switch terminals 21, 22 are respectively received in the space between the second side plates 191, 192. The two second fixing shafts 21', 22' respectively pass through the second axle holes 196 and the holes of the bent portion of the second switch terminals 21, 22 to rotatably connect the two second switch terminals 21, 22 to the second fixing member 19.

Figure 5:
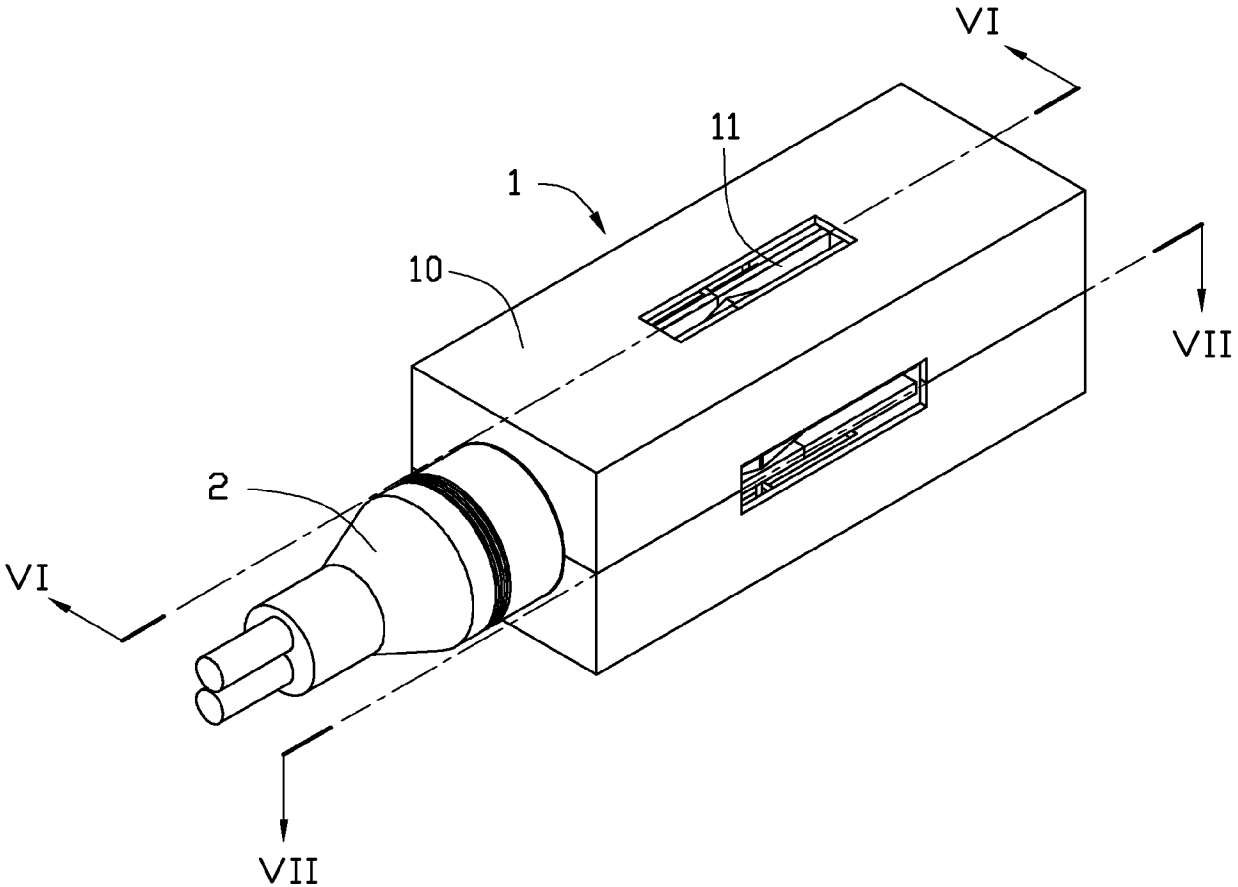
FIG. 5 shows the conventional plug connector received into the audio jack connector of FIG. 1.

Referring also to FIG. 5, when assembling the audio jack connector 1, the movable member 15 is engaged with the rotation member 16, one end of the elastic element 172 is connected to one end of the movable member 15 away from the inserting hole 12, and an opposite end is connected to the fixing portion 171. The first fixing member 18 is arranged around the movable member 15, and the second fixing member 19 is arranged around the rotation member 16. The two first switch terminals 23, 24 are rotatably connected to the first fixing member 18, and the two second switch terminals 21, 22 are rotatably connected to the second fixing member 19. The ends of the two first switch terminals 23, 24 away from the movable member 15 are respectively received in the recessed portion 162. The ends of the two second switch terminals 21, 22 away from the movable member 15 are respectively received in the recessed portion 162. Then, an upper cover and a lower cover is joined together to form the dielectric housing 10 to accommodate the above elements, with ends of the four pairs of the first side plates 181, 182, 184, 185 of the first fixing member 18 and the four pairs of the second side plates 191, 192, 194, 195 of the second fixing member 19 respectively received in the slots 101, 102, 103, and 104, thereby fixing the first fixing member 18 and the second fixing member 19 in the dielectric housing 10. One end of the spring 27 is connected to cylindrical member 26, and an opposite end is connected to the first fixing member 18, thereby elastically receiving the cylindrical member 26 in the opening 13 of the dielectric housing 10.

Figure 7:
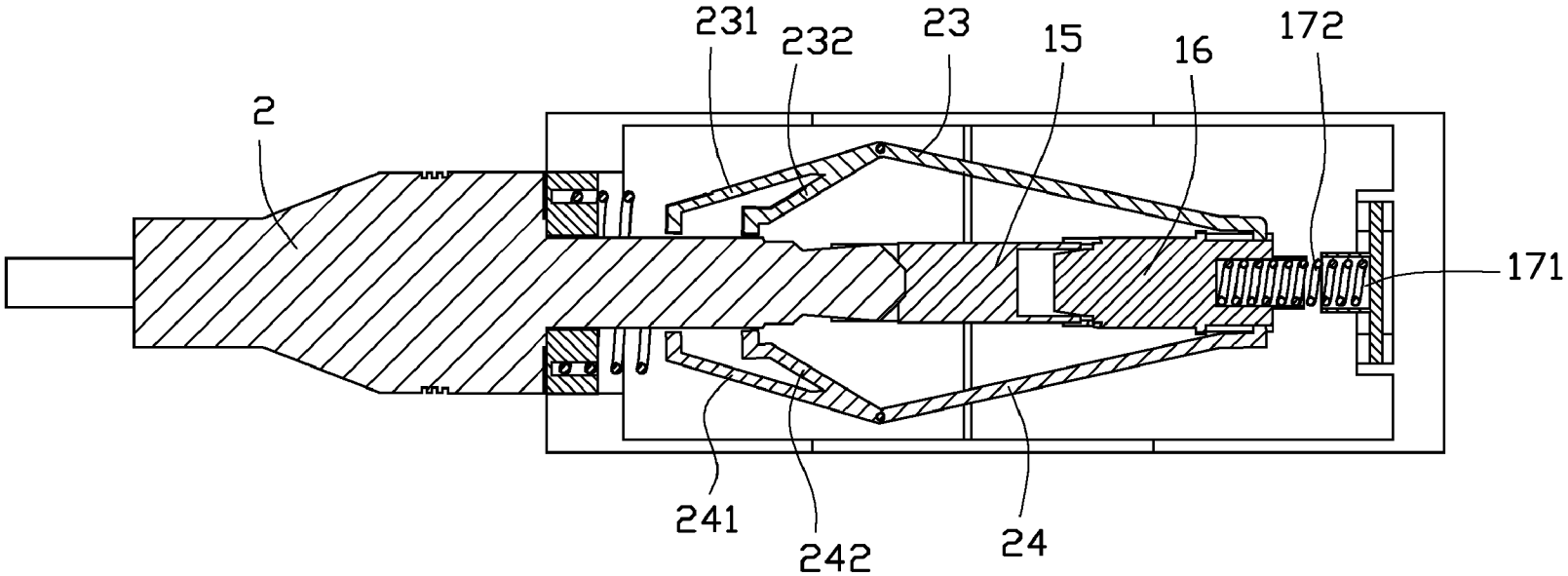
FIG. 7 is a cross-sectional view of the conventional plug connector and the audio jack connector of FIG. 5, taken along the line VII-VII.

Referring also to FIGS. 6-7, when inserting the conventional plug connector 2, the movable member 15 is pushed to move along a direction away from the inserting hole 12. During movement of the movable member 15, the tongues 151 of the movable member 15 cooperate with the sliding grooves 161 to drive the rotation member 16 to rotate, thereby driving the ends of the two first switch terminals 23, 24 and the two second switch terminals 21, 22 away from the movable member 15 to respectively move from the recessed portion 162 to the protrusion 163. Due to the level principle, the ends of the two first switch terminals 23, 24 and the two second switch terminals 21, 22 adjacent to the movable member 15 move toward and stay contact with the conventional plug connector 2, thereby fixing the plug connector 2 in the dielectric housing 10. Then, the prongs of the first switch terminals 23, 24 and the two second switch terminals 21, 22 contact the conventional plug connector 2 to establish an electrical connection.

To remove the conventional plug connector 2, because the cylindrical member 26 is elastically received in the opening 13, a user can push the conventional plug connector 2 to compress the cylindrical member 26, causing the conventional plug connector 2 to be further inserted into the inserting hole 12. During insertion of the conventional plug connector 2, the rotation member 16 rotates together with the movement of the movable member 15 again, causing the ends of the first switch terminals 23, 24 and the two second switch terminals 21, 22 to respectively move from the protrusions 163 to the recessed portions 162. Due to applying the level principle, the ends of the two first switch terminals 23, 24 and the two second switch terminals 21, 22 adjacent to the movable member 15 separates from each other, causing a limitation for the conventional plug connector 2 to be removed. Then, the conventional plug connector 2 can be removed from the dielectric housing 10. During movement of the movable member 15 away from the inserting hole 12, the elastic element 172 is compressed by the movable member 15. After the conventional plug connector 2 is removed, the elastic element 172 rebounds to drive the movable member 15 to return to an initial position.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An audio jack connector adapted for mating with a plug connector, the audio jack connector comprising:

a dielectric housing defining an inserting hole; a movable member movably accommodated in the dielectric housing, and aligned with the inserting hole;

a rotation member rotatably received in the dielectric housing, a plurality of elastic protrusions protruding from one end of the rotation member, a plurality of recessed portions being formed between every two protrusions;

at least one first switch terminal pivotably mounted in the dielectric housing, one end of each of the at least one first switch terminal adjacent to the movable member comprising two sub-switch terminals which respectively comprise a prong, and an opposite end of the first switch terminal being received in one of the recessed portions;

at least one second switch terminal pivotably mounted in the dielectric housing, one end of each of the at least one second switch terminal adjacent to the movable member comprising a prong, an opposite end of each of the at least one second switch terminal being received in one of the recessed portions;

wherein when the plug connector is inserted into the inserting hole, and pushes the movable member to move, the rotation member is driven to rotate by the movable member, which drives the ends of the at least one first switch terminals and the at least one second switch terminal to move from the recessed portions to the protrusions to rotate the at least one first switch terminal and the at least one second switch terminal, causing the prongs of the at least one first switch terminal and the at least one second switch terminal to stay contact with the plug connector.

2. The audio jack connector as described in claim 1, wherein one end of the movable member away from the inserting hole comprises a plurality of tongues, one end of the rotation member adjacent to the movable member comprises a plurality of sliding grooves, each sliding groove comprises an inclined surface, during the movement of the movable member, the plurality of tongues slide along the inclined surfaces of the sliding grooves to drive the rotation member to rotate.

3. The audio jack connector as described in claim 1, wherein the dielectric housing defines an opening in one end, the audio jack connector further comprises a cylindrical member and a spring, the cylindrical member is elastically received in the opening through the spring, the inserting hole is defined in the center of the cylindrical member.

4. The audio jack connector as described in claim 1, further comprising a first fixing member, wherein the first fixing member defines a through hole along its longitudinal direction, the movable member is movably received in the through hole.

5. The audio jack connector as described in claim 3, further comprising a base, wherein the base comprises a fixing portion and an elastic element, one end of the elastic element is connected to the fixing portion, and an opposite end is connected to one end of the movable member away from the inserting hole, when to remove the plug connector from the dielectric housing, the plug connector is pushed to drive the cylindrical member to compress the spring, and pushes the movable member to move, causing the elastic element to be compressed, the rotation member is driven to rotate again by the movable member to drive the ends of the at least one first switch terminals and the at least one second switch terminals to move from the protrusions to the recessed portions, causing the prongs of the at least one first switch terminals and the at least one second switch terminals to keep away from the plug connector, after the plug connector is removed, the spring decompresses to drive the cylindrical member to return to an initial position, and the elastic element rebounds to drive the movable member to return to an initial position.

6. The audio jack connector as described in claim 4, further comprising a second fixing member, wherein the second fixing member defines a through hole along its longitudinal direction, and communicating with the through hole of the first fixing member, the rotation member is rotatably received in the through hole of the second fixing member.

7. The audio jack connector as describe in claim 4, wherein both the numbers of the at least one first switch terminal and of the at least one second switch terminal are two, the first fixing member further comprises four sidewalls and four pairs of first side plates protruding from its four sidewalls, the two pairs of the first side plates each defines a first axle hole, the two first switch terminals each comprises a first fixing shaft, a hole is defined at a bent portion of each first switch terminal, the two first switch terminals are received in the space between the first side plates, the two first fixing shafts respectively pass through the first axle holes and the holes of the bent portion of the two first switch terminals to rotatably connect the two first switch terminals to the first fixing member.

8. The audio jack connector as describe in claim 6, wherein the second fixing member further comprises four sidewalls and four pairs of second side plates protruding from its four sidewalls, the two second side plates each defines a second axle hole, the two second switch terminals each comprises a second fixing shaft, a hole is defined at a bent portion of each second switch terminal, the two second switch terminals are respectively received in the space between the second side plates, the two second fixing shafts respectively pass through the second axle holes and the holes of the bent portion of the second switch terminals to rotatably connect the two second switch terminals to the second fixing member.

9. The audio jack connector as describe in claim 6, wherein the dielectric housing is hollow, and comprises four sidewalls, and defines four slots in it's the four sidewalls along a lengthwise direction thereof, the first fixing member and the second fixing member are accommodated in the dielectric housing, with four first side plates of the first fixing member and four second side plates of the second fixing member respectively received in the slots.

10. An audio jack connector adapted for mating with a plug connector, the audio jack connector comprising:

a dielectric housing defining an inserting hole;

a movable member movably accommodated in the dielectric housing, and aligned with the inserting hole;

a rotation member rotatably received in the dielectric housing, a plurality of elastic protrusions protruding from one end of the rotation member, a plurality of recessed portions being formed between every two protrusions;

two first switch terminals pivotably mounted in the dielectric housing, one end of each of the two first switch terminals adjacent to the movable member comprising two sub-switch terminals which respectively comprise a prong, and an opposite end of each of the two first switch terminal being received in one of the recessed portions; and two second switch terminals pivotably mounted in the dielectric housing, one end of each of the two second switch terminal adjacent to the movable member comprising a prong, an opposite end of each of the two second switch terminal being received in one of the recessed portions;

wherein when the plug connector is inserted into the inserting hole, and pushes the movable member to move, the rotation member is driven to rotate by the movable member, which drives the ends of the at least one first switch terminals and the at least one second switch terminal to move from the recessed portions to the protrusions to rotate the two first switch terminals and the two second switch terminals, causing the prongs of the two first switch terminals and the two second switch terminals to stay contact with the plug connector.

11. The audio jack connector as described in claim 10, wherein the dielectric housing defines an opening in one end, the audio jack connector further comprises a cylindrical member and a spring, the cylindrical member is elastically received in the opening through the spring, the inserting hole is defined in the center of the cylindrical member.

12. The audio jack connector as described in claim 11, wherein further comprising a base, wherein the base comprises a fixing portion and an elastic element, one end of the elastic element is connected to the fixing portion, and an opposite end is connected to one end of the movable member away from the inserting hole, when to remove the plug connector from the dielectric housing, the plug connector is pushed to drive the cylindrical member to compress the spring, and pushes the movable member to move, causing the elastic element to be compressed, the rotation member is driven to rotate again by the movable member to drive the ends of the first switch terminals and the two second switch terminals to move from the protrusions to the recessed portions, causing the prongs of the two first switch terminals and the two second switch terminals to keep away from the plug connector, after the plug connector is removed, the spring decompresses to drive the cylindrical member to return to an initial position, and the elastic element rebounds to drive the movable member to return to an initial position.

13. The audio jack connector as described in claim 10, further comprising a first fixing member, wherein the first fixing member defines a through hole along its longitudinal direction, the movable member is movably received in the through hole.

14. The audio jack connector as described in claim 13, wherein the first fixing member further comprises four sidewalls and four pairs of first side plates protruding from its four sidewalls, the two pairs of the first side plates each defines a first axle hole, the two first switch terminals each comprises a first fixing shaft, a hole is defined at a bent portion of each first switch terminal, the two first switch terminals are received in the space between the first side plates, the two first fixing shafts respectively pass through the first axle holes and the holes of the bent portion of the two first switch terminals to rotatably connect the two first switch terminals to the first fixing member.

15. The audio jack connector as described in claim 13, further comprising a second fixing member, wherein the second fixing member defines a through hole along its longitudinal direction, and communicating with the through hole of the first fixing member, the rotation member is rotatably received in the through hole of the second fixing member.

16. The audio jack connector as describe in claim 15, wherein the second fixing member further comprises four sidewalls and four pairs of second side plates protruding from its four sidewalls, the two second side plates each defines a second axle hole, the two second switch terminals each comprises a second fixing shaft, a hole is defined at a bent portion of each second switch terminal, the two second switch terminals are respectively received in the space between the second side plates, the two second fixing shafts respectively pass through the second axle holes and the holes of the bent portion of the second switch terminals to rotatably connect the two second switch terminals to the second fixing member.

* * * * *